US011674284B2

(12) United States Patent
Al-Jamea

(10) Patent No.: US 11,674,284 B2
(45) Date of Patent: Jun. 13, 2023

(54) LIFT STATION SAFETY SPIDER WEB

(71) Applicant: SAUDI ARABIAN OIL COMPANY, Dhahran (SA)

(72) Inventor: Khalid H. Al-Jamea, Shaybah (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 346 days.

(21) Appl. No.: 16/934,472

(22) Filed: Jul. 21, 2020

(65) Prior Publication Data

US 2022/0025606 A1 Jan. 27, 2022

(51) Int. Cl.

| | |
|---|---|
| ***E02D 29/12*** | (2006.01) |
| ***B08B 5/04*** | (2006.01) |
| ***B08B 9/035*** | (2006.01) |
| *D04G 1/00* | (2006.01) |

(52) U.S. Cl.

CPC ..... *E02D 29/127* (2013.01); *B08B 5/04* (2013.01); *B08B 9/035* (2013.01); *D04G 1/00* (2013.01); *E02D 2200/13* (2013.01); *E02D 2300/0004* (2013.01); *E02D 2300/0075* (2013.01); *E02D 2600/10* (2013.01)

(58) Field of Classification Search

CPC ..... E02D 29/127; E02D 29/1481; B08B 5/04; B08B 9/035

See application file for complete search history.

(56) References Cited

U.S. PATENT DOCUMENTS

| | | | |
|---|---|---|---|
| 4,986,389 | A | 1/1991 | Halligan, Sr. et al. |
| 5,265,974 | A | 11/1993 | Dargie |
| 5,787,955 | A | 8/1998 | Dargie |
| 6,182,790 | B1 | 2/2001 | Denny et al. |
| 2002/0020584 | A1 | 2/2002 | Cjepa |
| 2008/0217228 | A1 | 9/2008 | Landry |

(Continued)

FOREIGN PATENT DOCUMENTS

| | | | |
|---|---|---|---|
| CN | 104420481 A | | 3/2015 |
| CN | 104452817 A | | 3/2015 |
| CN | 104631504 A | * | 5/2015 |

(Continued)

OTHER PUBLICATIONS

Feather, Jarrah; "Sewer Pump Station Fall Prevention System"; 31st Annual Qld Water Industry Workshop—Operations Skills University Central Queensland—Rockhampton; Jul. 4-6, 2006; pp. 62-68; URL: <http://www.wioa.org.au/conference_papers/06_qld/documents/JarrahFeather.pdf> (7 pages).

(Continued)

*Primary Examiner* — Frederick L Lagman

(74) *Attorney, Agent, or Firm* — Osha Bergman Watanabe & Burton LLP

(57) ABSTRACT

A safety apparatus includes a safety fabric that in use is positioned in an access opening of a subsurface chamber. The safety fabric has a mesh with a plurality of mesh openings and a band formed around a perimeter of the mesh. At least one safety indicator is attached to the band by at least one strap. The safety indicator may be positioned outside of the access opening by extension of the strap when the safety fabric is positioned in the access opening. The subsurface chamber with the access opening may be an inlet chamber of a lift station.

18 Claims, 10 Drawing Sheets

(56) References Cited

U.S. PATENT DOCUMENTS

2012/0097590 A1 4/2012 Early et al.

FOREIGN PATENT DOCUMENTS

| | | | | |
|---|---|---|---|---|
| CN | 104762996 | A | * | 7/2015 |
| CN | 108265755 | A | | 7/2018 |
| DE | 202014003586 | U1 | | 7/2014 |
| JP | 2003049444 | A | | 2/2003 |
| KR | 200352256 | Y1 | * | 6/2004 |
| KR | 20090008184 | U | * | 8/2009 |
| KR | 20110009395 | U | * | 10/2011 |
| KR | 101184646 | B1 | * | 9/2012 |
| KR | 20150055492 | A | * | 5/2015 |
| WO | 2012/054965 | A1 | | 5/2012 |

OTHER PUBLICATIONS

"Hatch Net Opening"; U.S.F. Fabrication Inc.; Jun. 2004; URL: <http://www.usffab.com/usffab/wpcontent/uploads/2013/01/NETCLEARS.pdf> (1 page).

"Fall-Through Protection Solutions"; U.S.F Fabrication, Inc.; 2012; URL: <http://www.usffab.com/usffab/wp-content/uploads/2015/03/Fall-Through-Protection-Solutions.pdf> (6 pages).

International Search Report and Written Opinion issued in Application No. PCT/US2020/050981, dated Apr. 13, 2021 (17 pages).

* cited by examiner

LIFT STATION SAFETY SPIDER WEB

BACKGROUND

An oily water lift station is a pump station that moves oily water from a lower elevation to a higher elevation in a hydrocarbon facility. The lift station is constructed below ground level to allow collection of various streams of liquids from different locations by gravity. The liquids are separated inside the lift station and pumped out of the lift station for further processing. The depth of the lift station below ground level varies depending on the design of the facility served, but it can be as deep as 12 m. An oily water lift station typically has two chambers, an inlet chamber and a pump chamber, separated by a concrete wall to enhance separation of oil from water. Two sets of vertical pumps are typically used to pump the oil and water separately.

Under normal conditions, liquid level transmitters monitor the liquid level inside the lift station and activate the vertical pumps to reduce the liquid level when the liquid level is above a predetermined level without any interference from plant personnel. Occasionally, human intervention in the form of manually vacuuming the lift station with external vacuum tankers may be required. This may be due to the pumps failing to operate or accumulated water in the lift station that exceeds the pumping capacity of the pumps or routine maintenance of the lift station. The lift station typically has an access hole that is covered by a set of heavy weight steel cover plates. During occasions when human intervention is required, the access hole will have to be open to the surface. Since the lift station is considered to be a vertical confined space, safety protocol requires specially trained Operations personnel for the intervention if the lift station contains liquid.

Several operational risks are associated with human intervention in an oily water lift station. There is a risk of fire due to the fact that oily water lift stations can contain a large amount of flammable liquids and gases, which can ignite if exposed to an ignition source. In such cases, the risk may be mitigated by purging the lift station with nitrogen. While the access hole of the lift station is open, e.g., during or after maintenance work, the risk of falling into the lift station through the access hole is high. Since the lift station can be quite deep, e.g., more than 10 m deep, falling inside a dry lift station can be fatal. The atmosphere inside an oily water lift station is typically not suitable for breathing since the air volume can contain a substantial amount of hydrocarbon gases and/or hydrogen sulfide, which is a fatal gas if inhaled. In addition, oily water lift stations are designed to maintain a certain level of liquid inside the inlet chamber, e.g., around 3 m deep. This can cause drowning if someone falls inside the lift station. In such cases, intervention to rescue the person inside the lift station can only be made by certified Fire Protection personnel with special gear.

SUMMARY

In a first summary example, a safety apparatus includes a safety fabric that in use is positioned in an access opening of a subsurface chamber. The safety fabric includes a mesh having a plurality of mesh openings and a band formed around a perimeter of the mesh. The safety apparatus includes at least one safety indicator attached to the band by at least one strap. The at least one safety indicator is positioned outside of the access opening by extension of the at least one strap when the safety fabric is positioned in the access opening.

The safety apparatus may include at least one vacuum port formed in the mesh. The at least one vacuum port may include a hole and a reinforced pad formed around a perimeter of the hole. The safety apparatus may include two vacuum ports formed at opposite ends of the mesh. Each of the two vacuum ports may include a hole and a reinforced pad formed around a perimeter of the hole. The mesh may be made of a plurality of straps that are crisscrossed to form the mesh openings. The plurality of straps of the mesh and the at least one strap of the at least one safety indicator may be made of a synthetic fabric material. The synthetic fabric material may be a nylon material or a polyester material. The safety fabric may have a safety color. The at least one strap may have a safety color. The safety indicator may include a case carrying a warning label. The safety indicator may include at least one of a light source and an RFID tag. Eyelets may be formed in and along the band formed around a perimeter of the mesh. The eyelets may engage hooks on a surface in the access opening when the safety fabric is positioned in the access opening.

In a second summary example, a lift station includes an enclosure having a first subsurface chamber, a second subsurface chamber, and an access opening. The first subsurface chamber receives a liquid stream from a flowline, the second subsurface chamber is fluidly connected to the first subsurface chamber, and the access opening is connected to the first subsurface chamber. The lift station includes at least one pump having a suction end fluidly connected to the second subsurface chamber and operable to pump liquid out of the second subsurface chamber. The lift station includes a safety fabric removably positioned in the access opening. The safety fabric includes a mesh having a plurality of mesh openings and a band formed around a perimeter of the mesh. The lift station includes at least one safety indicator attached to the band by at least one strap. The at least one safety indicator is positioned outside of the enclosure by extension of the strap outside of the access opening. The lift station incudes at least one removable cover plate mounted over the access opening.

The at least one strap may be pinned to a wall of the enclosure by the at least one removable cover plate. The lift station may include at least one vacuum port formed in the mesh. The at least one vacuum port may include a hole and a reinforced pad formed around a perimeter of the hole. A plurality of removable cover plates may be mounted over the access opening. The at least one removable cover plate may include an indication of a location of the at least one vacuum port. The mesh may be made of a plurality of strap that are crisscrossed to form the mesh openings. Each of the safety fabric and the at least one strap may have a safety color. The safety indicator may include a case and at least one of a warning label, a light source, and an RFID tag carried by the case. The lift station may include a plurality of hooks attached to a wall of the access opening and a plurality of eyelets formed in and along the band. The plurality of eyelets may releasably engage the plurality of hooks to removably position the safety fabric in the access opening.

In a third summary example, a method of cleaning a lift station includes detecting at least one safety indicator coupled to a safety fabric disposed in an access opening of the lift station from outside of the lift station. At least one cover plate mounted over the access opening is removed to reveal the safety fabric. A hose of a vacuum tanker is inserted through a vacuum port formed in a mesh of the safety fabric into a subsurface chamber of the lift station. The vacuum tanker is operated to clean the subsurface chamber.

The foregoing general description and the following detailed description are exemplary of the invention and are intended to provide an overview or framework for understanding the nature of the invention as it is claimed. The accompanying drawings are included to provide further understanding of the invention and are incorporated in and constitute a part of the specification. The drawings illustrate various embodiments of the invention and together with the description serve to explain the principles and operation of the invention.

BRIEF DESCRIPTION OF DRAWINGS

The following is a description of the figures in the accompanying drawings. In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1:
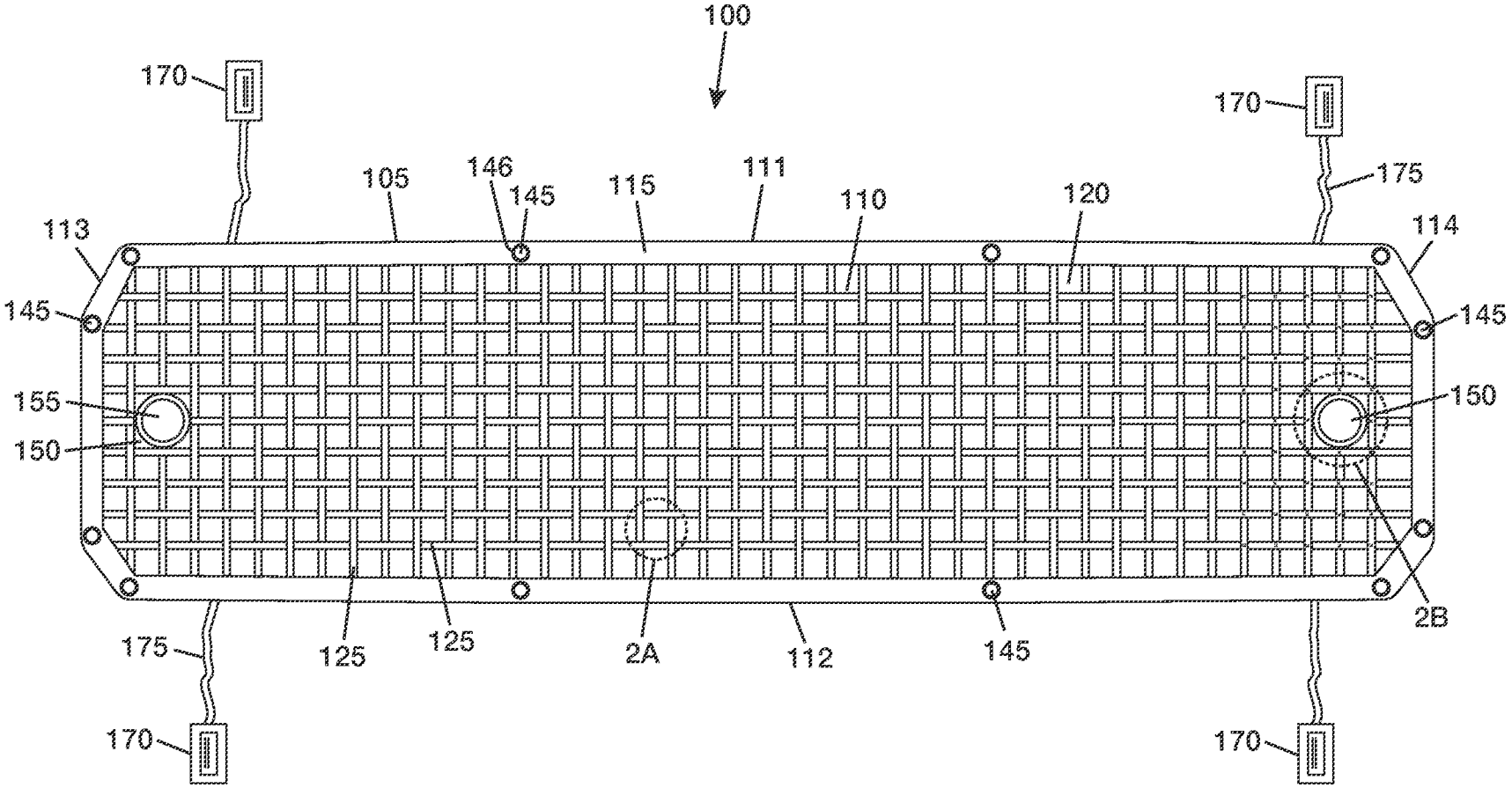
FIG. 1 shows a plan view of a safety apparatus.

In the following detailed description, certain specific details are set forth in order to provide a thorough understanding of various disclosed implementations and embodiments. However, one skilled in the relevant art will recognize that implementations and embodiments may be practiced without one or more of these specific details, or with other methods, components, materials, and so forth. In other instances, related well known features or processes have not been shown or described in detail to avoid unnecessarily obscuring the implementations and embodiments. For the sake of continuity, and in the interest of conciseness, same or similar reference characters may be used for same or similar objects in multiple figures.

FIG. 1 shows one illustrative implementation of a safety apparatus 100 that may be installed in an access hole of a lift station. When installed in the access hole of a lift station, safety apparatus 100 can mitigate fall hazards that may be accompanied by other hazards such as oxygen deficiency and drowning. Safety apparatus 100 includes a safety fabric 105, which may have a generally rectangular shape with long sides 111, 112 and short sides 113, 114. The shape can also be square or circular based on the shape of the access hole. Safety fabric 105 includes a mesh 110 and a band 115 formed around and connected to a perimeter of the mesh. Openings 120 in mesh 110 are formed by crisscrossing straps 125, which are made of a durable fabric material, such as nylon, polyester, or other durable synthetic fabric material. To allow clear identification and visibility of mesh 110, straps 125 preferably have a safety color, e.g., fluorescent orange, fluorescent orange-red, or yellow. Band 115 may be made of the same material as mesh straps 125. The ends of straps 125 are attached to band 115, for example, by permanent stitching. Holes 145 are formed in and along band 115. To prevent band 115 from being torn at holes 145, eyelets 146, which are usually made of metal (e.g., steel, aluminum, or bronze), are placed in holes 145. Eyelets 146 enable hanging of safety fabric 105 on wall hooks.

Figure 2B:
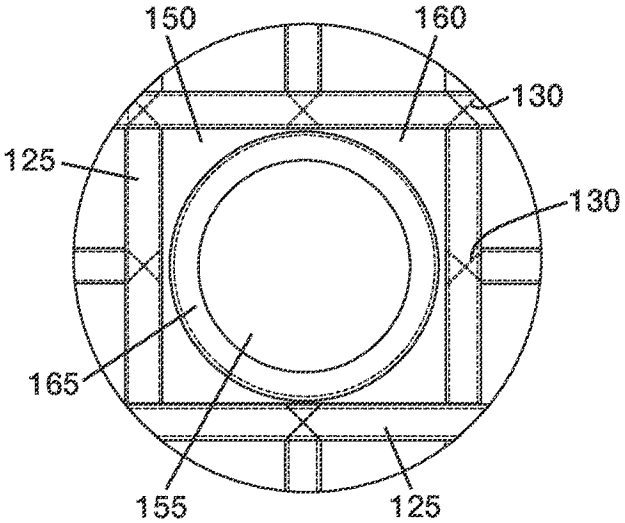
FIG. 2B shows an enlarged view of detail 2B in FIG. 1.
Figure 2A:
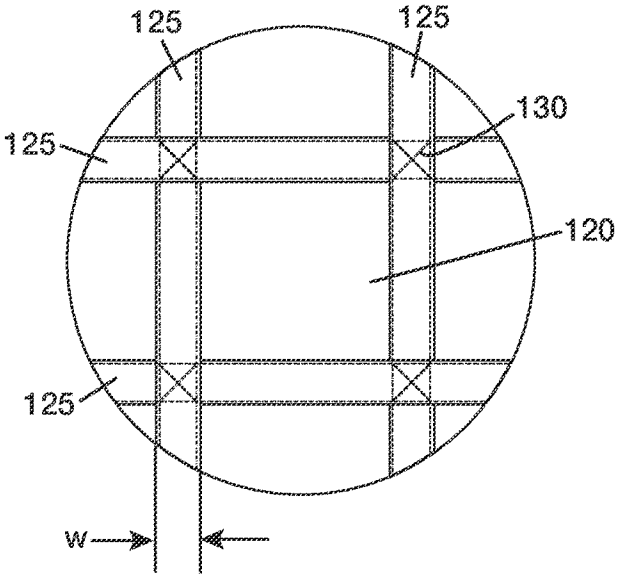
FIG. 2A shows an enlarged view of detail 2A in FIG. 1.

As shown in the detail of FIG. 2A, at each junction where mesh straps 125 overlap, a permanent stitch 130 is formed to hold the straps together. The stitch may be a cross-stitch, for example. Moreover, edge stitching may be used on each mesh strap 125 to avoid unraveling of the strap at the edges. In a non-limiting example, the width, w, of each strap 125 may be in a range from 2 inches (5.08 cm) to 3 inches (7.62 cm). In general, the width of the straps may be selected such that the safety fabric can safely carry a predetermined maximum weight, such as the weight of an average adult human or the weight of an equipment that may be dropped on the safety fabric when the safety fabric is in use. The crisscrossing of straps 125 may be such that mesh openings 120 have a square or rectangular shape. Each mesh opening 120 may have dimensions ranging from about 15 cm×15 cm to about 20 cm×20 cm to avoid fall through of equipment or human foot. In some cases, straps 125 may be arranged so that mesh openings have shapes other than square or rectangular. For example, straps may be arranged to form triangular mesh openings.

Returning to FIG. 1, vacuum ports 150 are provided at opposite ends of mesh 110, e.g., proximate to short sides 113, 114 of safety fabric 105. Each vacuum port 150 has an opening 155 for passage of tools through mesh 110. In one example, opening 155 is sized for passage of a vacuum tanker hose. When safety apparatus 100 is installed in an access hole of a lift station, vacuum port 150 would allow vacuuming of the lift station without having to remove the safety apparatus from the access hole. In a non-limiting example, the diameter of opening 155 may be about 36 cm, which is based on a typical vacuum tanker hose used in a hydrocarbon facility. As shown in the detail of FIG. 2B, vacuum port 150 may include a piece of fabric 160 that is attached to mesh straps 125, for example, by permanent stitching 130. Fabric piece 160 may be made of the same material as mesh straps 125. A hole is formed in fabric piece 160 to provide opening 155. A reinforcement pad 165 may be provided around opening 155 and stitched to fabric piece 160 to reinforce the opening. Reinforcement pad 165 may be made, for example, of two layers of the mesh strap material.

Returning to FIG. 1, safety apparatus 100 includes safety indicators 170, which are attached to safety fabric 105 by straps 175. As an example, straps 175 may be stitched to band 115 to attach safety indicators 170 to safety fabric 105. Straps 175 have a suitable length to allow safety indicators 170 to be disposed outside of a lift station while safety fabric 105 is hung within an access hole of the lift station. In use, safety fabric 105 will be hidden inside lift station by cover plates that cover the access hole. Therefore, safety indicators 170 will provide a visual indication that safety apparatus 100 has been installed at the lift station during safety inspection, eliminating the need to open up the cover plates for such inspection. Safety indicator straps 175 may be made of the same material as mesh straps 125. Preferably, straps 175 have a safety color, such as fluorescent orange, fluorescent orange-red, or yellow, which would allow the straps and attached safety indicators 170 to be easily identified during safety walkthroughs.

Figure 3B:
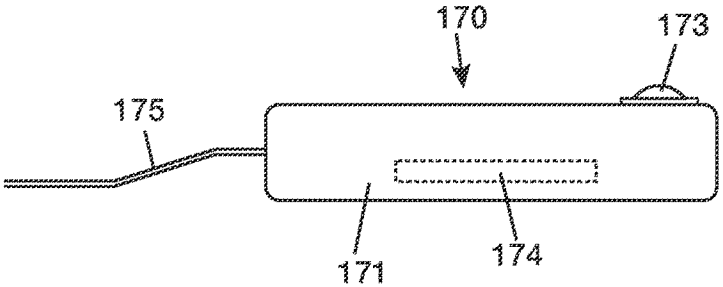
FIG. 3B shows a side view of the safety indicator of FIG. 3B.
Figure 3A:
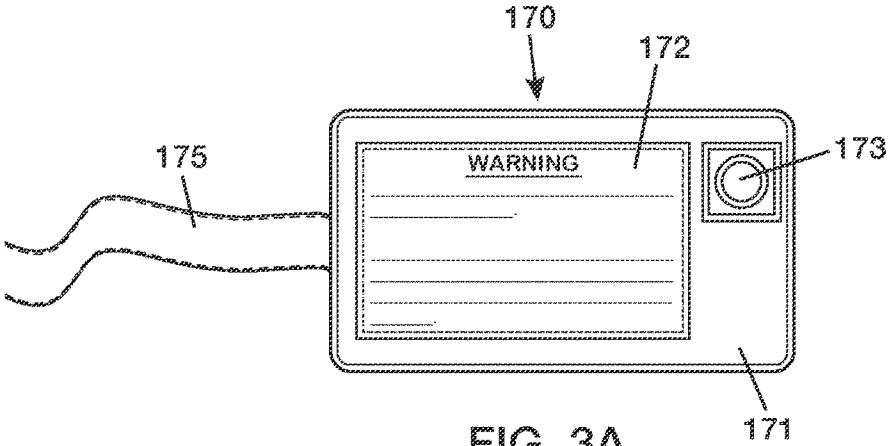
FIG. 3A shows a plan view of a safety indicator.

Referring to FIGS. 3A and 3B, safety indicator 170 may include case 171 carrying a printed warning label 172. The exterior of case 171 may have a safety color in order to allow easy identification of the safety indicator. Case 171 may be made of the same material as strap 175 and may be connected to strap 175 by stitching. In one example, safety indicator 170 may include a light source 173, such as a LED, that emits visible warning light. Light source 173 may be mounted to case 171. In another example, safety indicator 170 may include electronic sensors or devices that can sense when the safety indicator is detached from the safety fabric and can send an alert signal to a plant control room to indicate that the safety indicator has been detached. In one particular example, case 171 may carry a radio-frequency identification (RFID) tag 174 or other transponder that will allow communication between the safety indicator and a nearby reader. The RFID tag may be an active device that actively beams information to the reader. Alternatively, the RFID tag may be a passive device that beams information only when interrogated by the reader. The reader may use information received from the RFID tag to detect whether the safety indicator associated with the RFID tag is in the appropriate location. The reader may send an alert signal to a plant control room if the safety indicator is not in the appropriate location.

Figure 4:
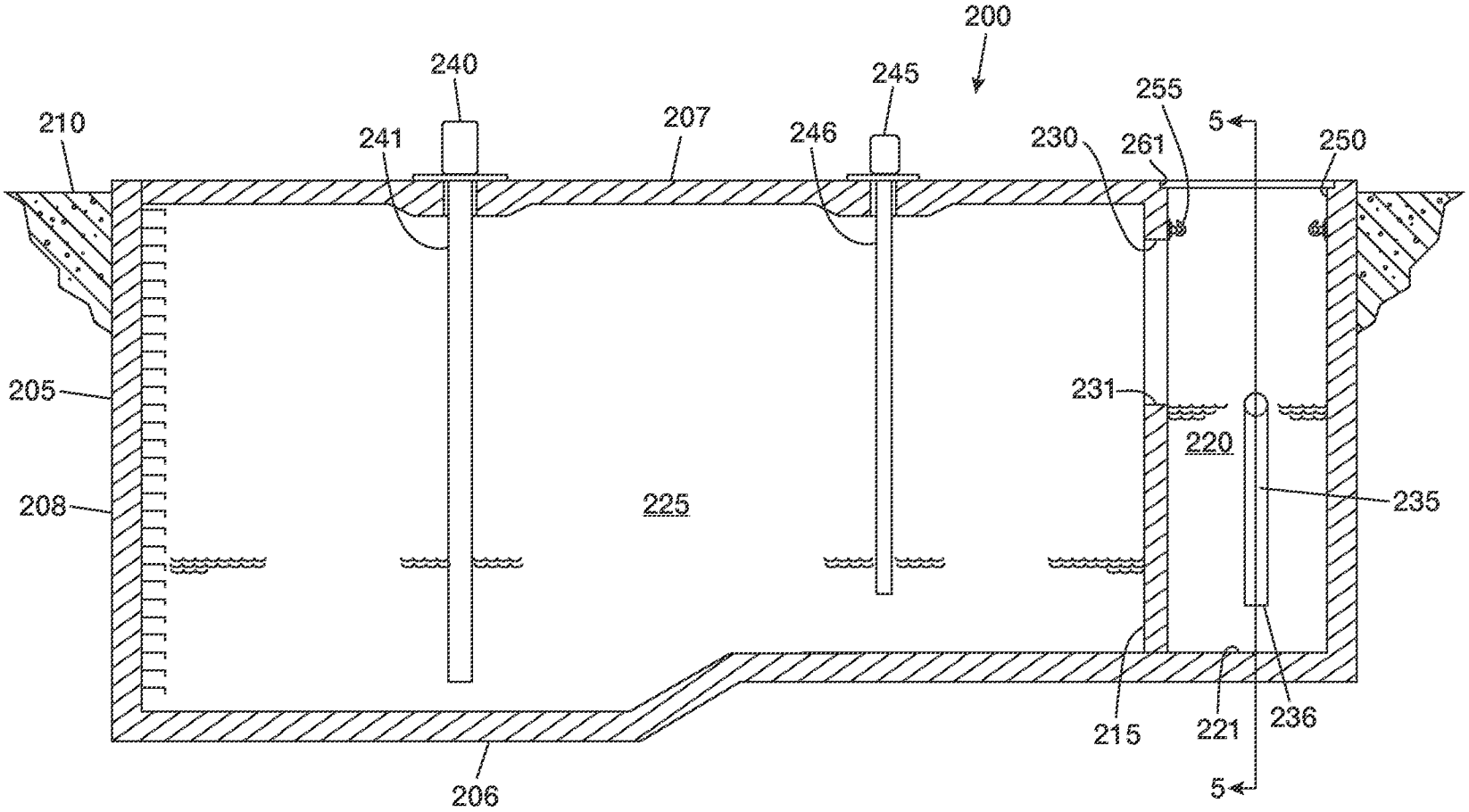
FIG. 4 shows a cross-sectional view of a lift station with hooks for installing the safety apparatus of FIG. 1.
Figure 5:
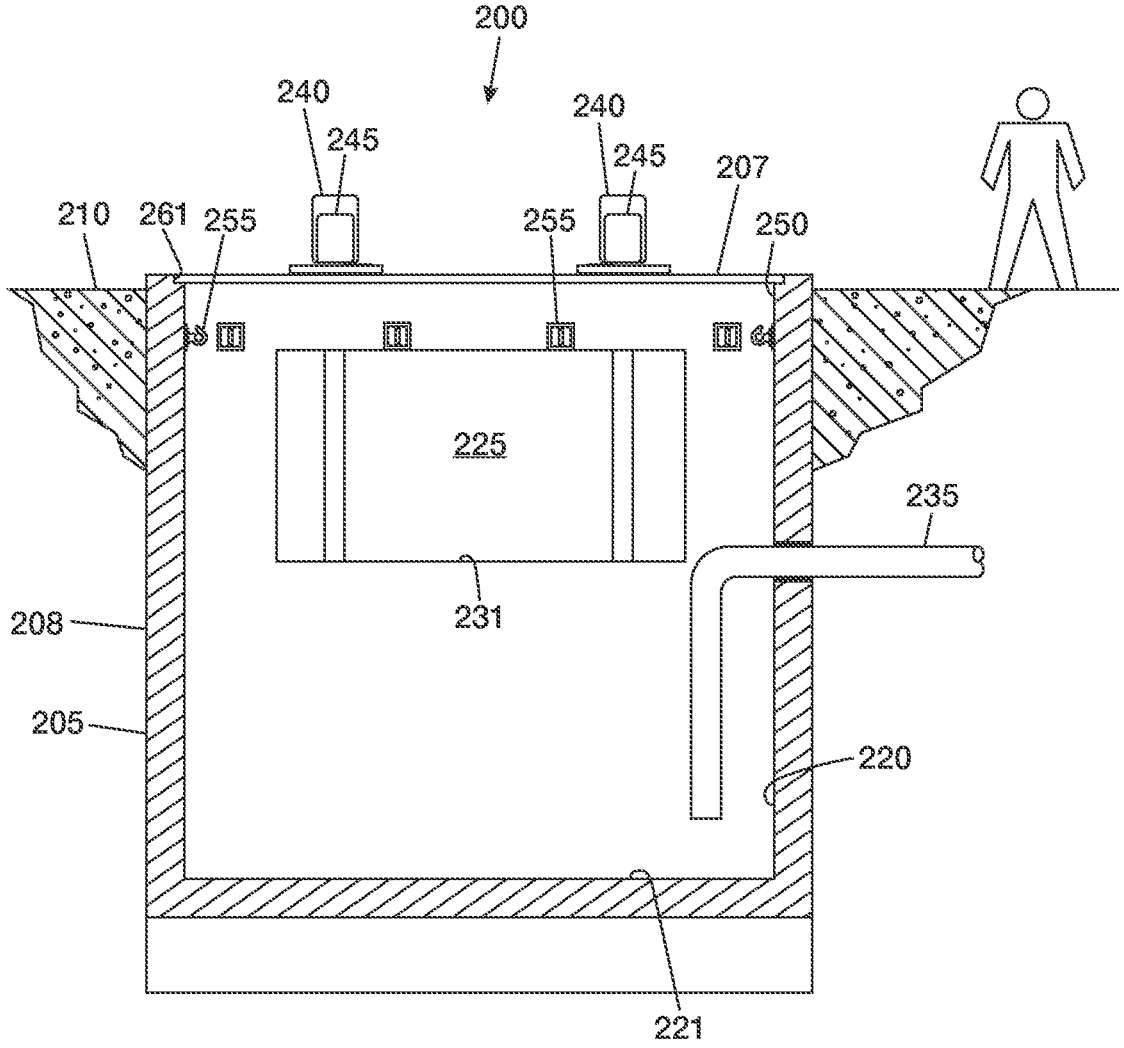
FIG. 5 shows a cross-sectional view of the lift station of FIG. 4 along line 5-5.

FIGS. 4 and 5 show an example lift station 200 prior to installing a safety apparatus in the lift station. Lift station 200 includes an underground enclosure 205 having a bottom wall 206, a top wall 207, and an enclosing side wall 208. Top wall 207 may be flush with or slightly higher than ground level 210. Walls 206, 207, and 208 may be made of concrete or steel plates. A vertical wall 215 inside lift station 200 partitions the inner volume of lift station 200 into an inlet chamber 220 and a pump chamber 225. Wall 215 may be made of concrete. An access opening 250 is positioned at the top of inlet chamber 220 and extends through top wall 207. A seat 261 may be formed at the ground level entrance of access opening 250. Cover plates may be mounted in seat 261 to cover access opening 250 at the ground level. For installation of the safety apparatus, hooks 255 are arranged along the wall of access opening 250. Hooks 255 are offset from seat 261 such that there will be a vertical distance between the safety fabric when hung on the hooks and the cover plates.

An upper portion of vertical wall 215 includes an opening 230 that is fluidly connected to chambers 220, 225. A bottom edge 231 of opening 230 is set at a predetermined height above a bottom surface 221 of inlet chamber 220. As an example, this height may be at least 3 m. When the liquid level in inlet chamber 220 is above bottom edge 231, liquid will overflow from inlet chamber 220 into pump chamber 225 through opening 230. Liquid stream is delivered into inlet chamber 220 through a flowline 235 that extends from the outside of lift station 200 into inlet chamber 220. The outlet end 236 of flowline 235 is directed towards bottom surface 221 of inlet chamber 220. As inlet chamber 220 fills with the liquid stream, separation of the liquid stream will occur, with the heavier liquid, e.g., water, and solids settling at the bottom of inlet chamber 220 and the lighter liquid, e.g., oil, floating on top of the heavier liquid. Pumps 240, 245 are installed on top wall 207, with suction pipes 241, 246 of the pumps extending into pump chamber 225. Pumps 240, 245 may be activated when liquid rises above a predetermined level inside chamber 225. There are level transmitters located inside chamber 225. These level transmitters measure the liquid level inside chamber 225 and trigger operation of pumps 240, 245. Pump 240 may be a deluge pump and may be used to pump water out of the lift station, and pump 245 may be a gravity sewer pump and may be used to pump oil out of the lift station.

Figure 6:
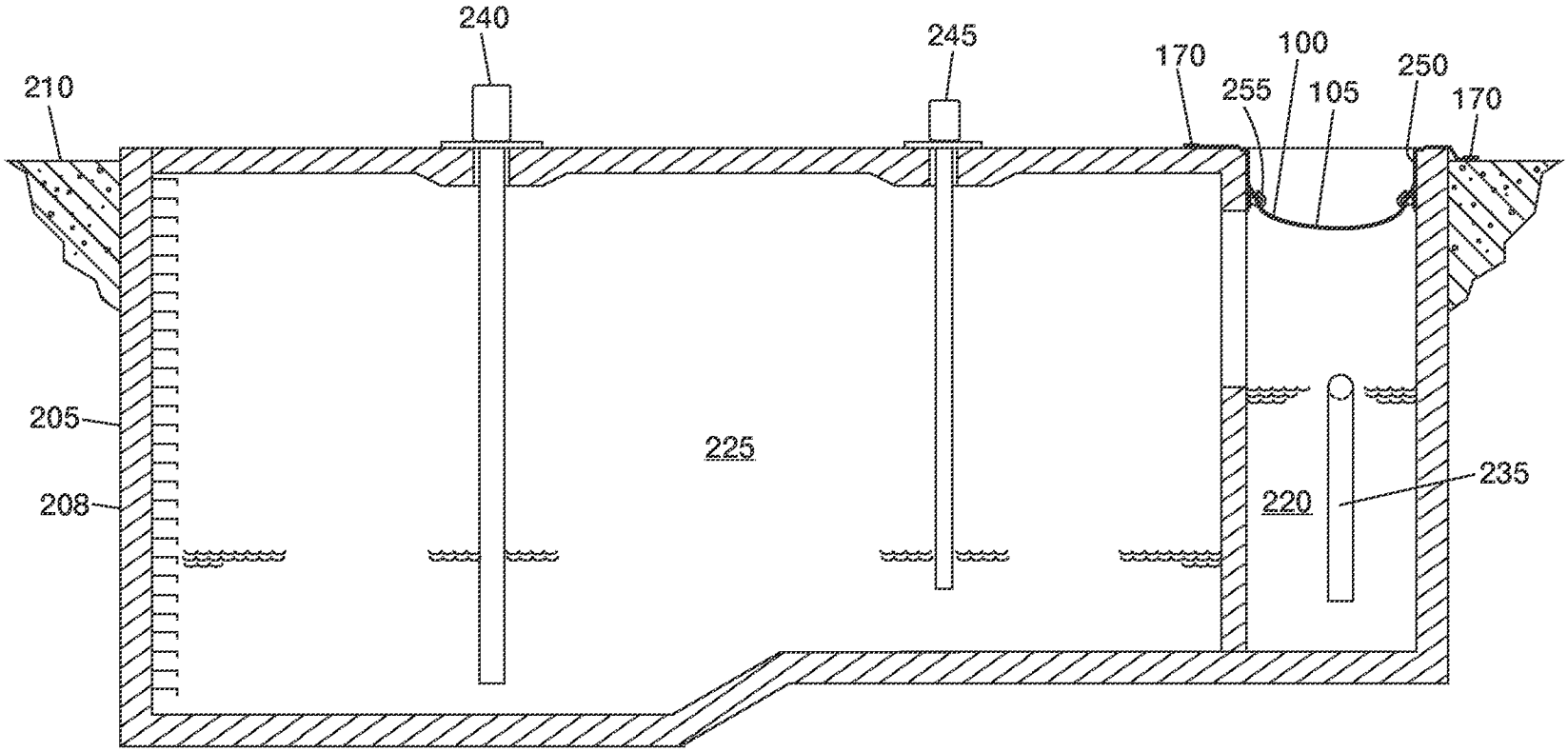
FIG. 6 shows the safety apparatus of FIG. 1 installed in the lift station of FIG. 4.
Figure 7:
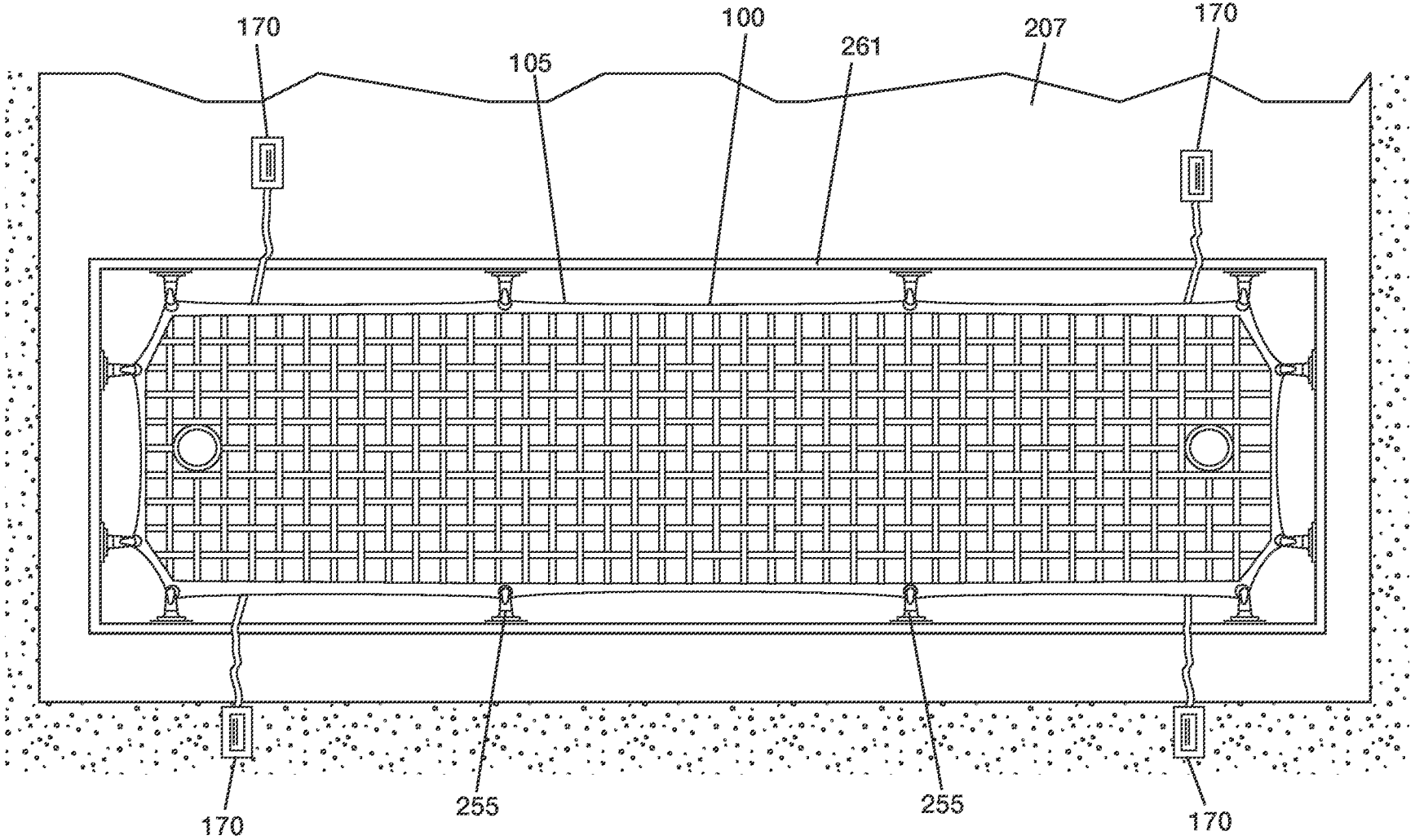
FIG. 7 shows a partial top view of the lift station of FIG. 6 with the installed safety apparatus.
Figure 8:
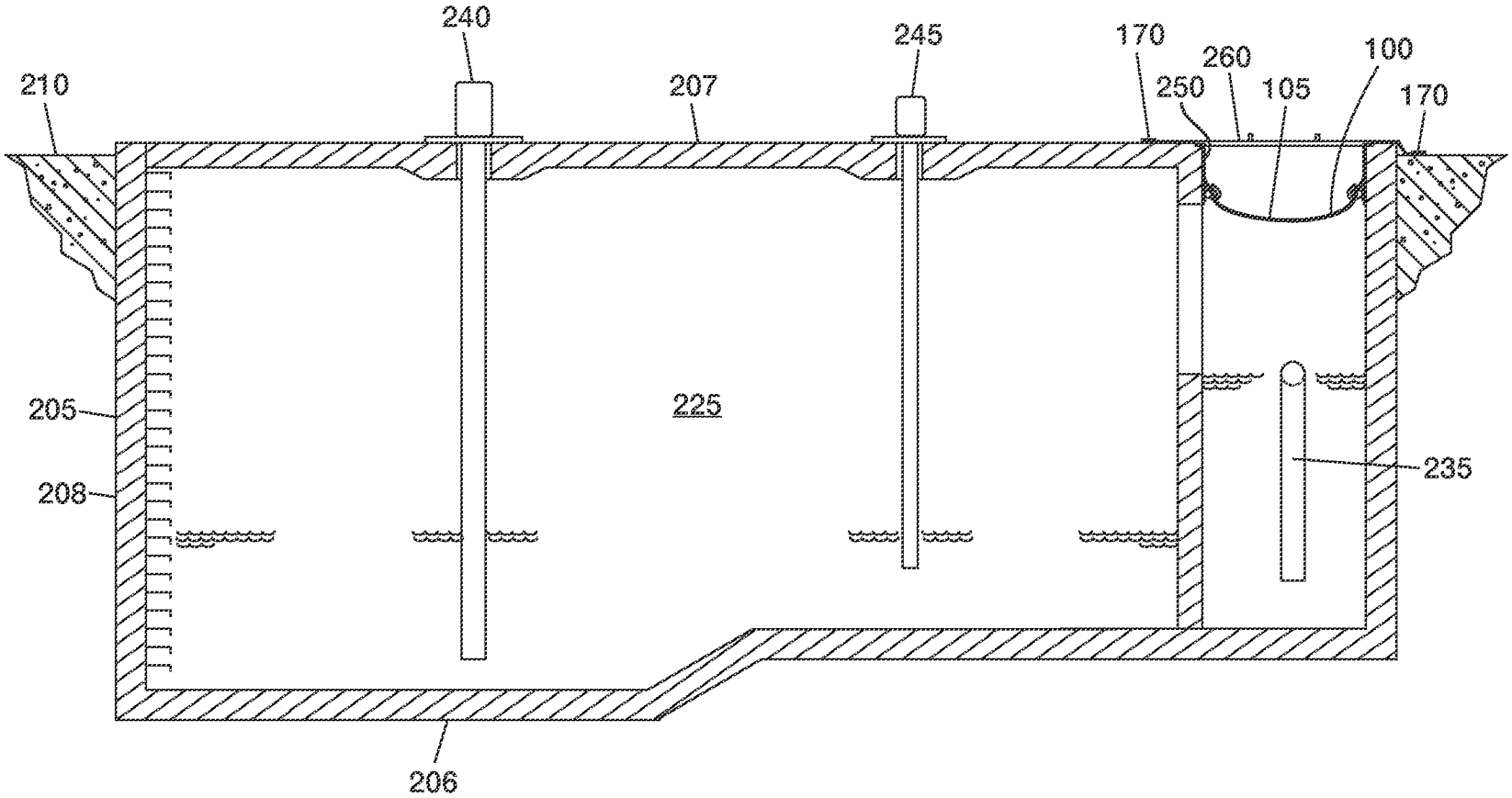
FIG. 8 shows cover plates mounted over the safety fabric installed inside the lift station of FIG. 6.
Figure 9:
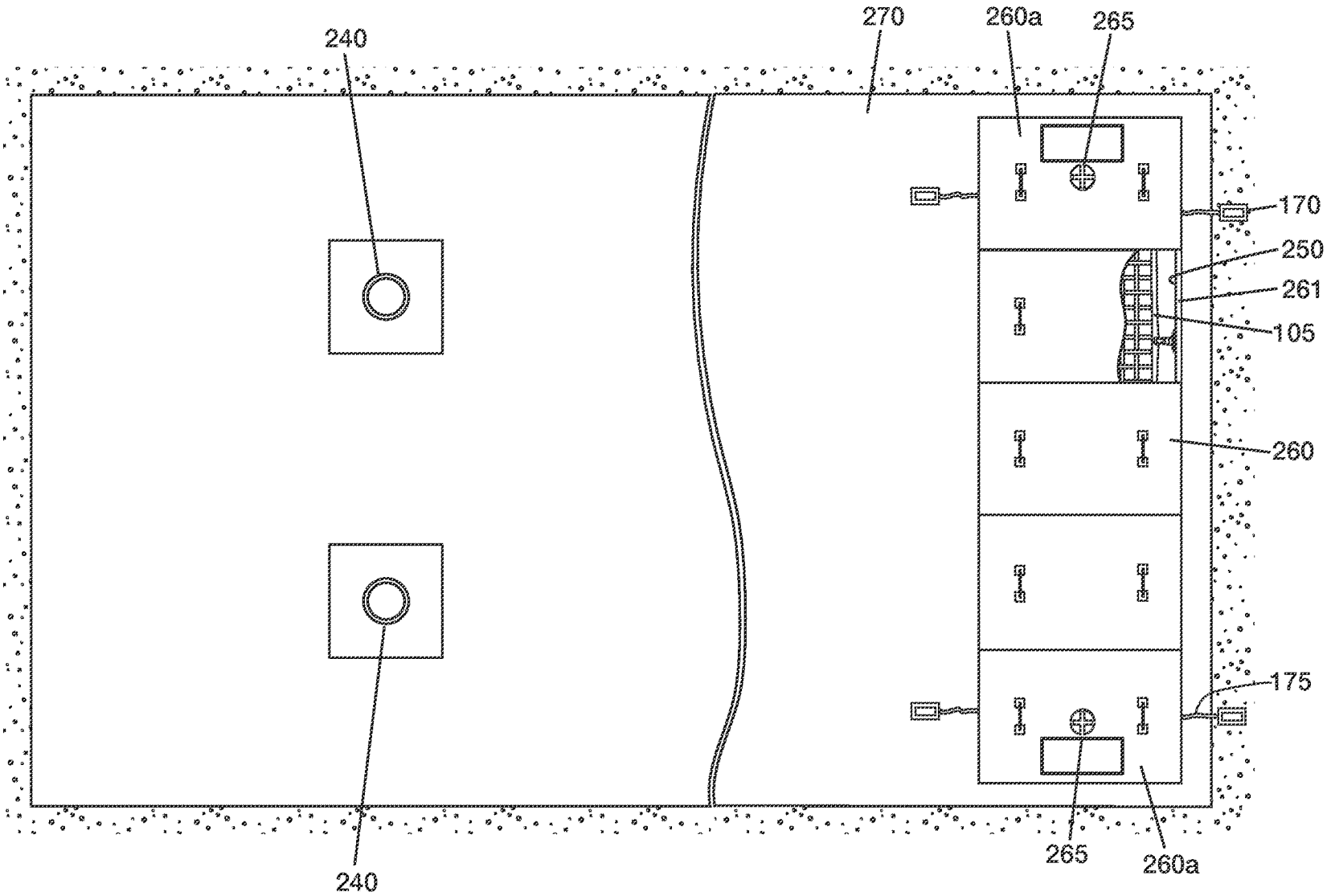
FIG. 9 shows a top view of the lift station of FIG. 8 with the cover plates.
Figure 10:
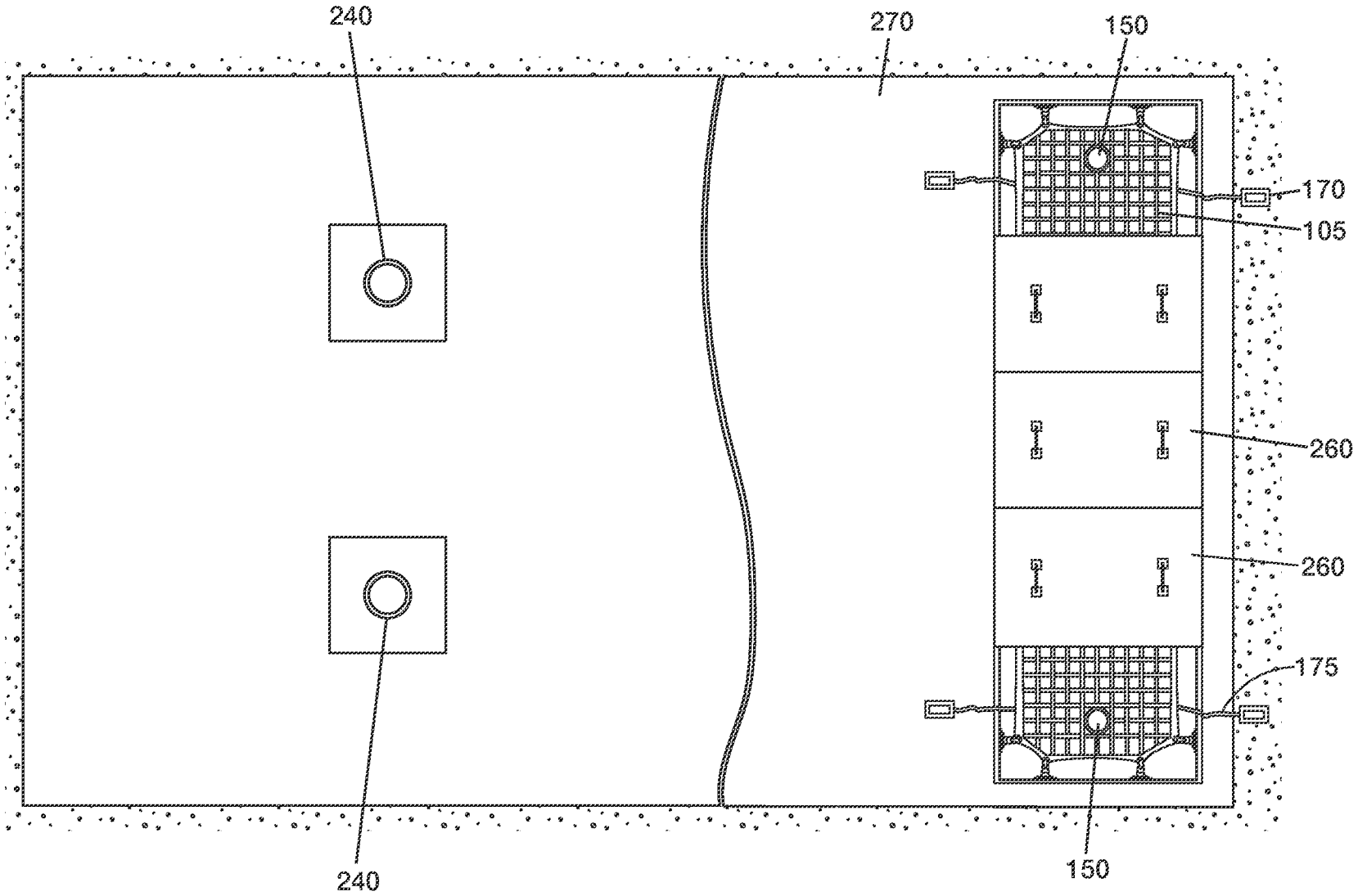
FIG. 10 shows cover plates removed from the lift station of FIG. 9 to reveal vacuum ports.
Figure 11:
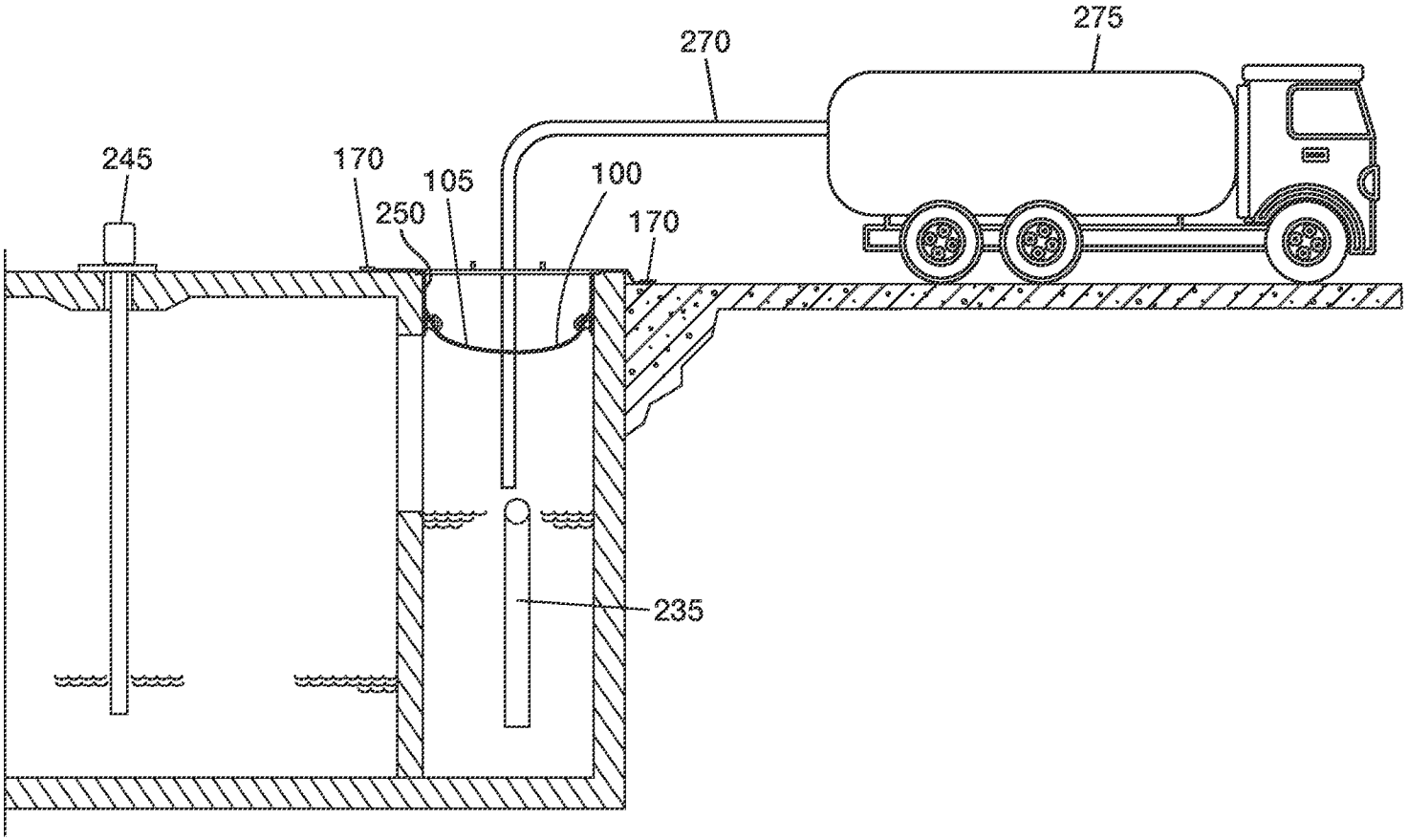
FIG. 11 shows a vacuum tanker with a hose inserted through a safety apparatus mounted at an access opening of a lift station.

FIGS. 6 and 7 show safety fabric 105 hung on hooks 255 in access hole 250. Safety indicators 170 are outside of access opening 250, where they would be visible from the ground level. FIGS. 8 and 9 show cover plates 260 mounted in seat 261 and over access opening 250. Cover plates 260 may be heavy weight steel plates. Straps 175 attached to safety indicators 170 may extend over seat 261 and may be pinned to seat 261 by cover plates 260. Cover plates 260*a* (in FIG. 9) mounted over the portion of safety fabric 105 including vacuum ports (150 in FIG. 1) may have visual indicators 265 to indicate the location of the vacuum ports. When it is desired to clean out the lift station, cover plates 260*a* may be removed to allow access to vacuum ports 150, as shown in FIG. 10. As shown in FIG. 11, the lift station may be vacuumed by inserting a vacuum tanker hose 270 through the vacuum ports and without having to remove the safety apparatus from the access opening. Once the vacuum tanker hose 270 is inside the lift station, the vacuum tanker 275 can be operated to clean the lift station.

The detailed description along with the summary and abstract are not intended to be exhaustive or to limit the embodiments to the precise forms described. Although specific embodiments, implementations, and examples are described herein for illustrative purposes, various equivalent modifications can be made without departing from the spirit and scope of the disclosure, as will be recognized by those skilled in the relevant art.

The invention claimed is:

1. A safety apparatus comprising:
   - a safety fabric that in use is positioned in an access opening of a subsurface chamber, the safety fabric comprising a mesh having a plurality of mesh openings and a band formed around a perimeter of the mesh;
   - at least one vacuum port formed in the mesh, the at least one vacuum port comprising a hole and a reinforced pad formed around a perimeter of the hole; and
   - at least one safety indicator attached to the band by at least one strap, the at least one safety indicator to be positioned outside of the access opening by extension of the at least one strap when the safety fabric is positioned in the access opening.

2. The safety apparatus of claim 1, further comprising two vacuum ports formed at opposite ends of the mesh, each of the two vacuum ports comprising a hole and a reinforced pad formed around a perimeter of the hole.

3. The safety apparatus of claim 1, wherein the mesh is made of a plurality of straps that are crisscrossed to form the mesh openings.

4. The safety apparatus of claim 3, wherein the plurality of straps and the at least one strap are made of a synthetic fabric material.

5. The safety apparatus of claim 3, wherein the plurality of straps and the at least one strap are made of a nylon material or a polyester material.

6. The safety apparatus of claim 1, wherein the safety fabric has a safety color.

7. The safety apparatus of claim 1, wherein the at least one strap has a safety color.

8. The safety apparatus of claim 1, wherein the safety indicator comprises a case carrying a warning label.

9. The safety apparatus of claim 8, wherein the safety indicator comprises at least one of a light source and an RFID tag.

10. The safety apparatus of claim 1, further comprising eyelets formed in and along the band, the eyelets to engage hooks on a surface in the access opening when the safety fabric is positioned in the access opening.

11. A lift station comprising:

an enclosure having a first subsurface chamber, a second subsurface chamber, and an access opening, the first subsurface chamber to receive a liquid stream from a flowline, the second subsurface chamber fluidly connected to the first subsurface chamber, the access opening connected to the first subsurface chamber;

at least one pump having a suction end fluidly connected to the second subsurface chamber and operable to pump liquid out of the second subsurface chamber;

a safety fabric removably positioned in the access opening, the safety fabric comprising a mesh having a plurality of mesh openings and a band formed around a perimeter of the mesh;

at least one vacuum port formed in the mesh, the at least one vacuum port comprising a hole and a reinforced pad formed around a perimeter of the hole;

at least one safety indicator attached to the band by at least one strap, the at least one safety indicator positioned outside of the enclosure by extension of the strap outside of the access opening; and at least one removable cover plate mounted over the access opening.

12. The lift station of claim 11, wherein the at least one strap is pinned to a wall of the enclosure by the at least one removable cover plate.

13. The lift station of claim 11, wherein a plurality of removable cover plates are mounted over the access opening, and wherein the at least one removable cover plate includes an indication of a location of the at least one vacuum port.

14. The lift station of claim 11, wherein the mesh is made of a plurality of straps that are crisscrossed to form the mesh openings.

15. The lift station of claim 11, wherein each of the safety fabric and the at least one strap has a safety color.

16. The lift station of claim 15, wherein the safety indicator comprises a case and at least one of a warning label, a light source, and an RFID tag carried by the case.

17. The lift station of claim 11, further comprising a plurality of hooks attached to a wall of the access opening and a plurality of eyelets formed in and along the band, the plurality of eyelets releasably engaging the plurality of hooks to position the safety fabric in the access opening.

18. A method of cleaning a lift station, the method comprising:

detecting at least one safety indicator coupled to a safety fabric disposed in an access opening of the lift station from outside of the lift station;

removing at least one cover plate mounted over the access opening to reveal the safety fabric;

inserting a hose of a vacuum tanker through at least one vacuum port formed in a mesh of the safety fabric into a subsurface chamber of the lift station, wherein the at least one vacuum port comprises a hole and a reinforced pad formed around a perimeter of the hole; and operating the vacuum tanker to clean the subsurface chamber.

* * * * *